US006082771A

United States Patent [19]

Long et al.

[11] Patent Number: 6,082,771

[45] Date of Patent: Jul. 4, 2000

[54] HANDLE ATTACHMENT FOR A FOLDER

[75] Inventors: Robert J. Long, Lake-In-The Hills; Jeffery S. Lippeth, Grays Lake, both of Ill.

[73] Assignee: Acco Brands, Inc., Lincolnshire, Ill.

[21] Appl. No.: 09/141,596

[22] Filed: Aug. 28, 1998

Related U.S. Application Data

[60] Provisional application No. 60/056,262, Aug. 29, 1997, and provisional application No. 60/056,264, Aug. 29, 1997.

[51] Int. Cl.[7] ..... B42D 3/00

[52] U.S. Cl. ..... 281/37; 16/110 R; 16/115; 190/900; 281/36; 281/51; 294/138; 402/4

[58] Field of Search ..... 16/110.5, 110 R, 16/115; 281/36, 43, 51, 37, 15.1, 19.1; 402/4; 294/138; 190/900

[56] References Cited

U.S. PATENT DOCUMENTS

| | | | |
|---|---|---|---|
| Re. 8,039 | 1/1878 | Reynolds . | |
| 753,585 | 3/1904 | Koch . | |
| 957,459 | 5/1910 | Duesler . | |
| 1,248,100 | 11/1917 | Fisch et al. | 16/115 |
| 1,269,859 | 6/1918 | Ring . | |
| 1,484,882 | 2/1924 | Gray | 16/115 |
| 1,600,970 | 9/1926 | Bosca | 16/115 |
| 1,800,254 | 4/1931 | Holmes | 16/115 |
| 1,889,962 | 12/1932 | Johnson . | |
| 1,958,587 | 5/1934 | Mitchell et al. | 16/115 |
| 2,051,907 | 8/1936 | Schade . | |
| 2,086,489 | 7/1937 | Bowersox | 16/115 |
| 2,987,151 | 6/1961 | Frambes | 16/115 |
| 3,159,411 | 12/1964 | McKowen . | |
| 3,168,173 | 2/1965 | Koffler | 16/115 |
| 3,175,847 | 3/1965 | McKowen . | |
| 3,186,114 | 6/1965 | Carter . | |
| 3,262,454 | 7/1966 | Shillinger . | |
| 3,289,798 | 12/1966 | Gehrie | 16/115 |
| 3,447,196 | 6/1969 | Szabo | 16/115 |
| 3,447,197 | 6/1969 | Szabo | 16/115 |
| 3,566,436 | 3/1971 | Marks et al. | 16/115 |
| 3,631,975 | 1/1972 | Leibowitz . | |
| 4,098,443 | 7/1978 | Coen et al. . | |
| 4,315,642 | 2/1982 | Errichiello . | |
| 4,583,877 | 4/1986 | Wilson . | |
| 4,634,193 | 1/1987 | Liu | 312/107 |
| 4,986,572 | 1/1991 | Kuykendall . | |
| 4,988,229 | 1/1991 | Ramsey, III . | |
| 5,417,456 | 5/1995 | Laubacher . | |

*Primary Examiner*—Andrea L. Pitts
*Assistant Examiner*—Monica Smith Carter
*Attorney, Agent, or Firm*—Pennie & Edmonds LLP

[57] ABSTRACT

An attachment for a folder includes a handle and a boot attachable to a folder. The boot has a boot recess in which a handle body of the handle is received when the handle is in a retracted position, in which the boot surrounds the handle body. A support member of the handle is attached to the handle body and is movably associated with the boot below the boot surface. Thus, the handle body is retractably extendable from the retracted position to an extended position in which the handle body is spaced from the boot back for enabling grasping of the handle body by a user.

25 Claims, 5 Drawing Sheets

HANDLE ATTACHMENT FOR A FOLDER

This application claims benefit of Provisional Application Ser. No. 60/056,262, filed Aug. 29, 1997, and Provisional Application Ser. No. 60/056,264, filed Aug. 29, 1997.

BACKGROUND OF THE INVENTION

Folders are known which include a handle on one or more panels of thereof. For example, U.S. Pat. No. 4,098,443 teaches a book with an integral handle extending from a spine section of the book. The handle requires a special spine disposed on the inside of the book cover, to which the handle is directly connected, and from which page groups are mounted. Also, the handle protrudes from the outer surface of the book cover with angular edges and would thus catch when the if the book were slid against an object, such as a shelf. Also, the spine portion of the book cover remains exposed, and subject to wear and tear.

U.S. Pat. No. 1,269,859 teaches a music holder with two covers and a back. A handle is disposed on the back and lies thereagainst. The handle itself and attachments that secure the handle to the back protrude with angular edges from the cover of the book, also easily catching on objects adjacent to the handle.

A handle attachment for a folder is needed which is not prone to catching on shelves or other objects and which provides a graspable surface for increased ease of use.

SUMMARY OF THE INVENTION

The invention relates to an attachment for folders that has a handle and a boot that surrounds the handle. The handle is movable from a retracted position in which the body of the handle is received in a recess of the boot, to an extended position in which the handle body is spaced from the boot to enable carrying by a user. The boot prevents the handle from catching on objects adjacent thereto, such as a shelf when the folder is placed thereon. The boot also prevents wear and absorbs impact to portions of the folder that are otherwise susceptible to damage, such as seams and corners of the folder, extending the useful life of the folder. The boot and handle also preferably have a rounded rubber surface that provides a comfortably grippable portion for a user.

BRIEF DESCRIPTION OF THE DRAWINGS

FIG. 8 is a partial end view there of.

DETAILED DESCRIPTION OF THE PREFERRED EMBODIMENTS

Figure 1:
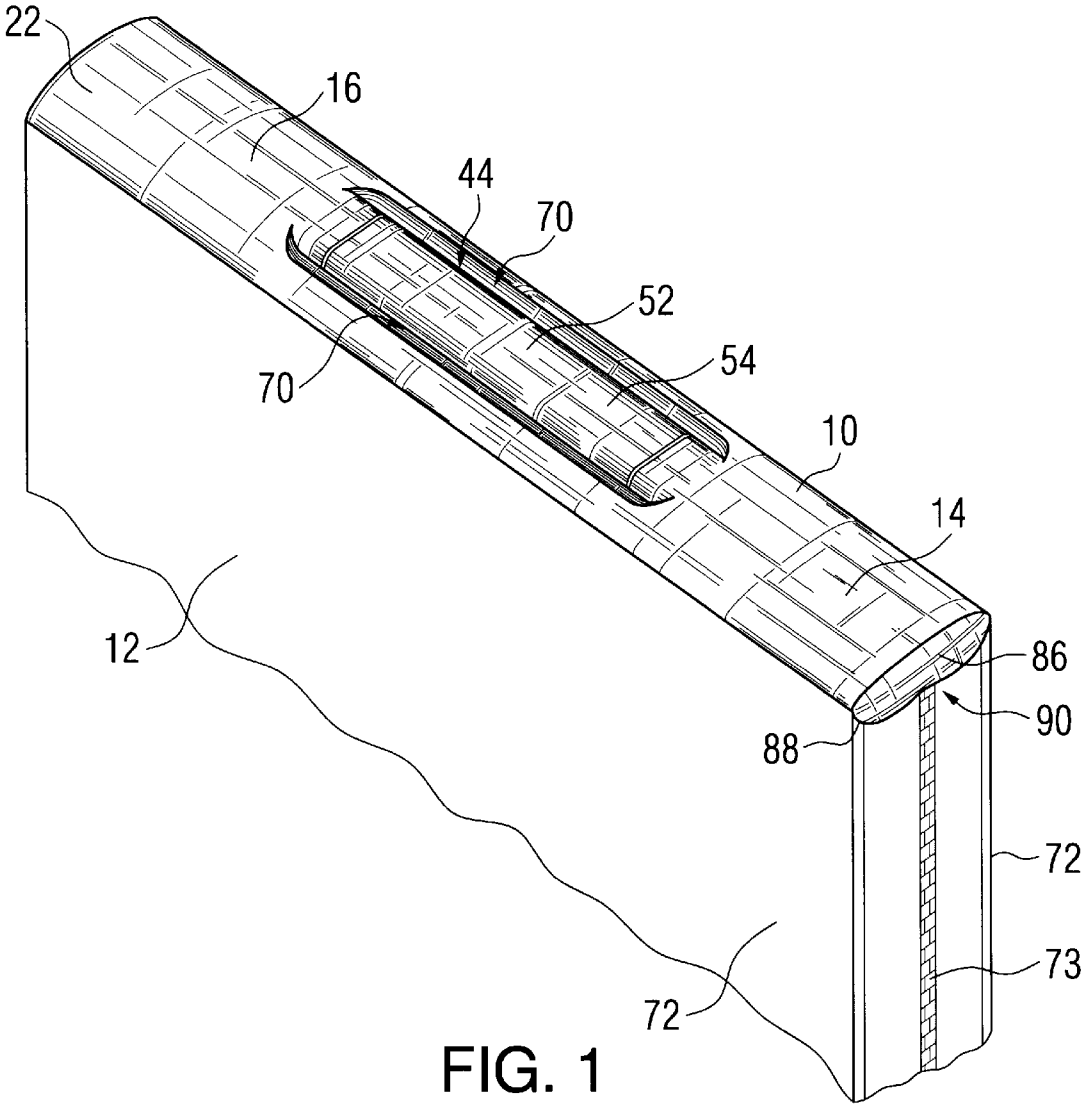
FIG. 1 is a cutaway perspective view of an a folder with an attachment constructed according to the present invention.

Referring to FIGS. 1–4, attachment 10 is attached to an exterior of a folder 12, such as a notebook, folio, or planner. The attachment 10 includes a boot 14 that has an outer surface 16, which follows a smooth contour and runs the length of the folder 12. The boot 14 has a back with an at least semirigid skeleton 18 of sufficient stiffness to retain the shape of the outer surface 16 boot 14. The skeleton 18, preferably made from ABS plastic, also includes ribs 20 extending towards the folder 12 to support the skeleton and retain the shape thereof during impact against the attachment 10. The skeleton 18 also includes columns 21 with threaded bores to receive fasteners.

The back also has a resilient cover 22 which is less stiff than the skeleton 18, is disposed therearound, and defines the outer surface 16 to provide a grippable surface for a user of the folder 12. Even when used with a folder 12 that has only flat sides, the outer surface 16 of the attachment 10 provides a more comfortable surface which is easily grasped by the user than the outside surface of the folder 10. The cover 22 is preferably made from an elastomer such as rubber and is overmolded around the skeleton 18 to include sprues 24 which penetrate openings in the skeleton 18 and reattach to the outer portion of the cover 22, locking to the skeleton 18. The cover 20 has a lip 25 around the underside of the skeleton 18 to hold the cover 22 thereon.

A rigid plate 26 of the boot 14 underlies the back of the boot 14 and is disposed between the back and spine 28 of the folder 12. The plate 26 includes a guide member with rails 30, which include races 32 with elongated slots attachable perpendicular to the base of the plate 26. The plate is attachable to spine 36 of the folder 12. Each race 32 terminates with a stop 34 at one end. At the opposite end from the stop 34, each race 32 is open at a race opening 37. A control portion including a pin 38 extends laterally across each guide member 30. Notches 40 receive columns 21 of the skeleton 18 in interlocking relationship for preventing relative movement therebetween tangent to the folder spine 36.

A recess 44 with a handle opening 46 is defined through the cover 22 and skeleton 18, interrupting the outer boot surface 16. A handle positioner 48 is mounted to the plate 26, facing the handle opening 46, with protrusions 50 of the positioner 48 that are received in openings 51 of the plate 26. At least one of the protrusions 50 preferably has a widened end to prevent separation of the positioner from the plate 26. The lateral ends of the positioner 48 are sloped to allow handle support members, discussed below, to slide adjacent the positioner 48.

Figure 2:
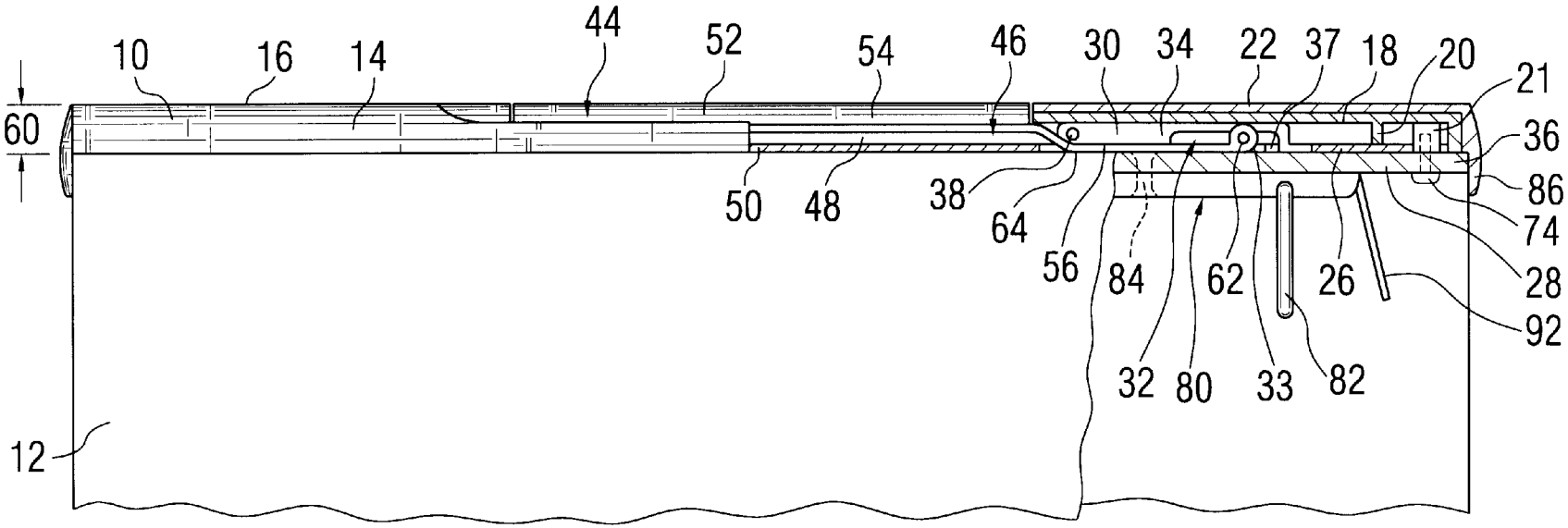
FIG. 2 is a partial cross-sectional side view thereof with the handle retracted.
Figure 3:
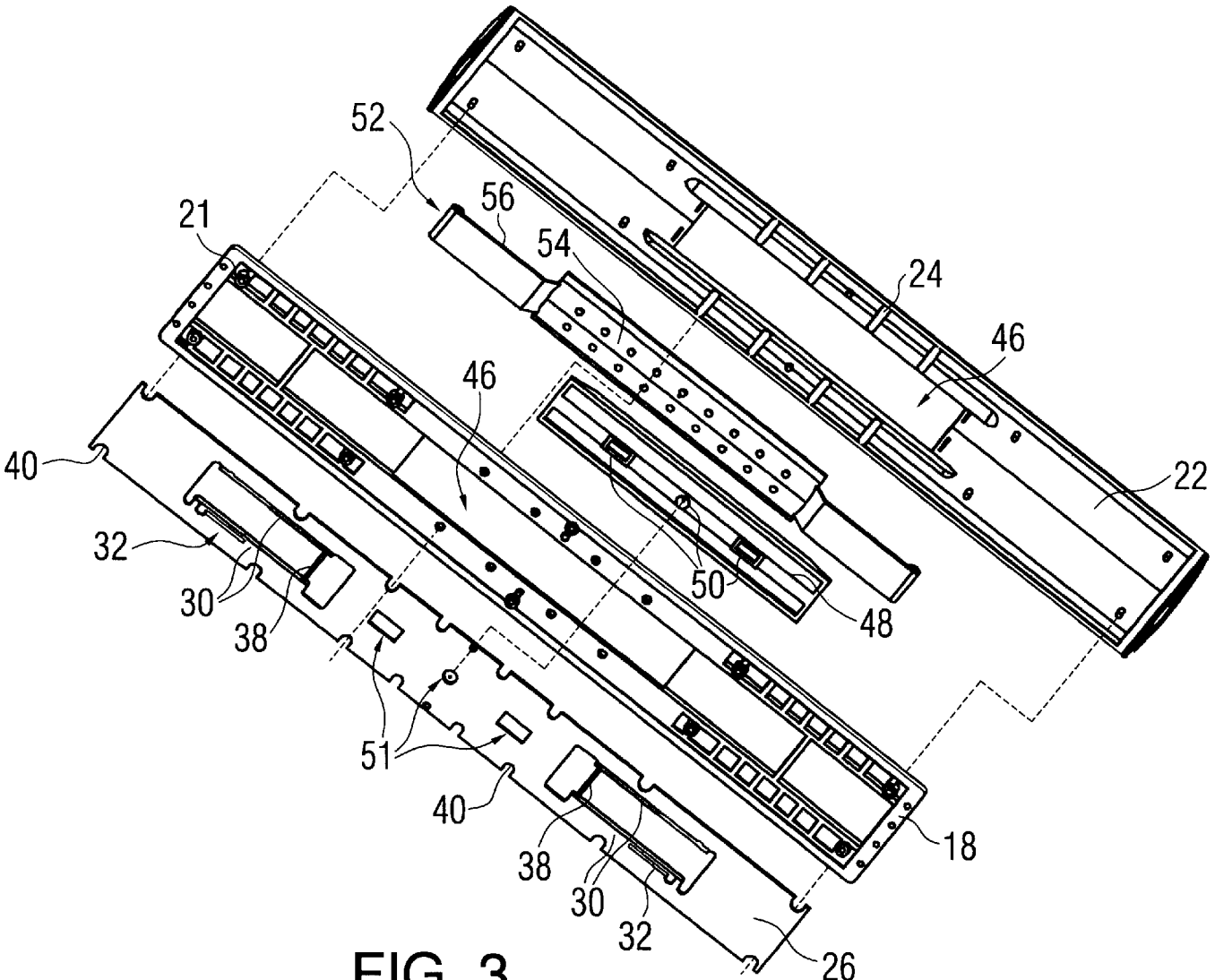
FIG. 3 is an exploded view of the attachment.
Figure 4:
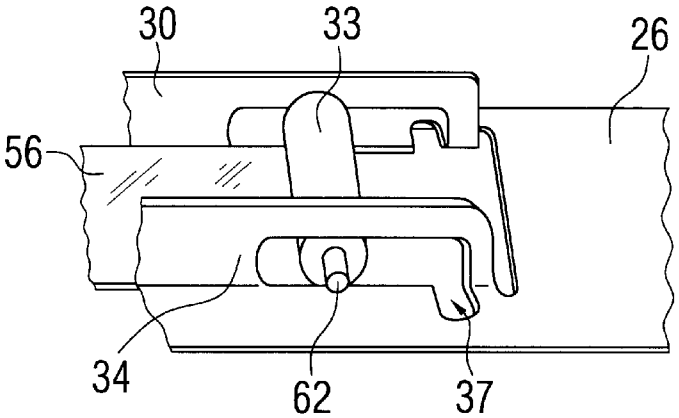
FIG. 4 is a cutaway perspective view of a guide member thereof.
Figure 5:
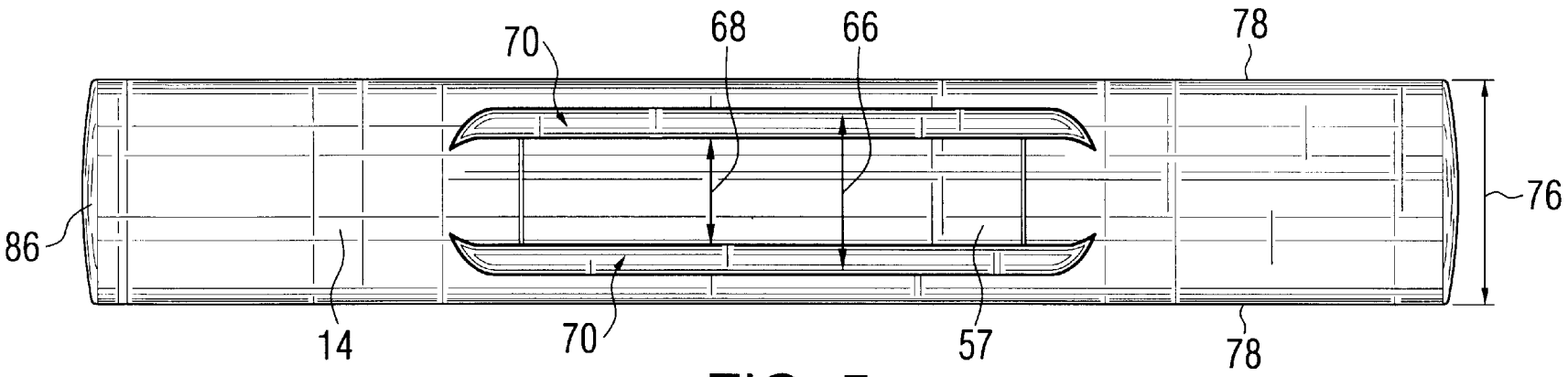
FIG. 5 is a top view thereof.

The attachment 10 also has a handle 52 with a handle body 54 attached to support members 56, which are preferably made from a single, substantially flat strip. The handle body 54 and the cover 22 comprise the same material that forms the outer boot surface 16. The handle body 54 is receivable through the handle opening 46. During assembly, the handle body 54 is passed through the handle opening 46. With the back of the boot 14, including the skeleton 18 and cover 22, placed against the plate 26, the handle body 52 is supported by the positioner 48. The positioner 48 is configured to position handle surface 58 to generally continue the smooth outer contour of the outer surface 16 of the boot 14 when the handle 52 is in a retracted position. In the preferred embodiment, the handle surface 58 is generally flush with the outer boot surface 16 when in the retracted position and is surrounded by the boot 14 and extends along the lateral sides of the handle body. FIGS. 2 and 5 show the boot surrounding substantially the entire handle body in a plane generally parallel to the recess 44. The positioner 48 also blocks the handle body from further retraction into the handle opening 46 beyond the retracted position. In the retracted position, the height 60 of the handle surface 58 above the base of the boot 14 is similar to the height of the outer surface 16 of the boot 14 above its base.

Each support member 56 has a guided portion, which preferably is a laterally extending pin 62 received in races 32 and in a cylindrical end member 63 of the support member 56. Controlled portion 64 of each support member 56 passes below the pin 38, controlling the path of the support member 56 when the handle 52 is retracted and extended. Thus, the handle 52 is movably associated with the races 32 below the outer boot surface 16.

As shown in FIG. 5 the handle body 54 has lateral sides having a length and separated by a width that is substantially smaller than the length. Also, the recess width 66 extending laterally thereacross is wider than the handle width 68 extending laterally thereacross. The recess 44 is configured to such that a grasping indentation 70 is defined on each side of the handle body 54 for receiving a user's fingertips for grasping of the handle body 54.

Figure 6:
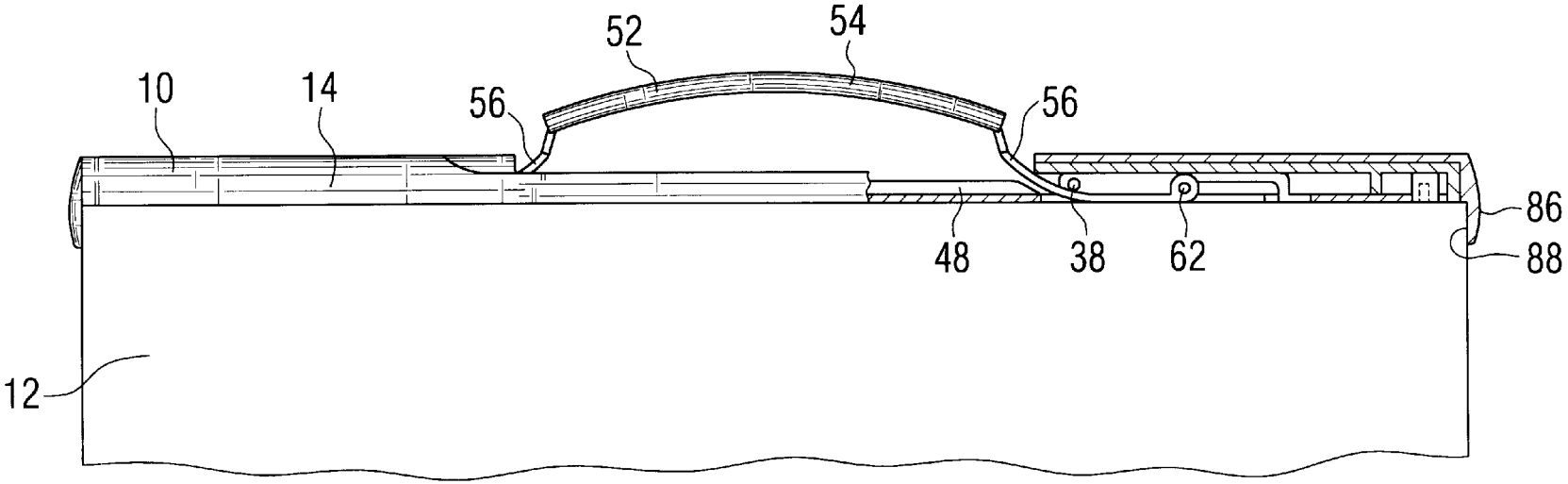
FIG. 6 is a partial cross-sectional view thereof with the handle extended.

Referring to FIG. 6, when the handle 52 is grasped and lifted from the recess 44, the support members 56 pull the pins 62 along the races 32 towards the handle body 54 until pins 62 contact the stop 34, which prevents further extraction of the handle body 54 from the recess 44. The support members 56 move around pins 38 as the handle 52 is moved to the extracted position shown, spaced from the boot back for enabling grasping of the handle body 54 by a user.

The resiliency of the support member 56 and handle body 54 biases the handle body 54 towards the retracted position, rendering this the naturally assumed position of the handle 52 when released. Also, this resiliency permits insertion of the pins 62 in the race 32 during assembly by pulling the pins 62 away from the handle body 54, past their naturally assumed position, and upwardly into the race openings 37 by stretching the support members 56.

The folder 12 preferably includes rigid or semirigid panels, including folder covers 72 and the spine 36 pivotably attached together at seams or shoulders. A closure, such as a zipper and attached fabric strips 73, preferably releasibly attaches the folder covers 72. The boot 14 is attachable preferably to the spine 36, with the base of the boot 14 in abutment therewith. Fasteners 74 extend from the inside of the folder 12, through the spine 36, and into the columns 21 of the skeleton 18, retaining the plate 26 against the spine 36.

Width 76 of the boot 14 between lateral edges 78 thereof other is approximately the same as the width of the spine 36 to protect the entire spine 36 from wear and impact. Preferably, the boot 14 is substantially coextensive with the spine 36 edges and overlies the spine edges 36.

Figure 7:
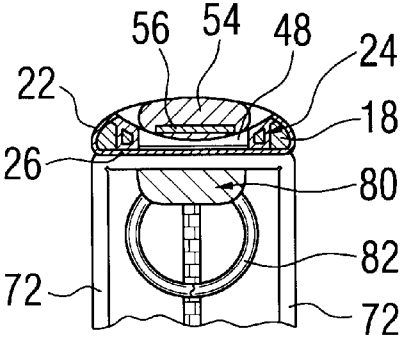
FIG. 7 is a cross-sectional end view thereof.

Referring to FIGS. 2 and 7, a binder assembly 80, preferably including binder rings 82 for holding papers, is fixed to the folder 12 with rivets 84, which extend through the folder 12 but not through the attachment 10. The fasteners 74 are disposed outside the perimeter of the binder assembly 80 and are independent therefrom. Also shown in FIG. 7 is the concave outer surface of the handle positioner 84, which corresponds to the shape of the handle body 54 to support the handle body 54 over a large area.

Figure 8:
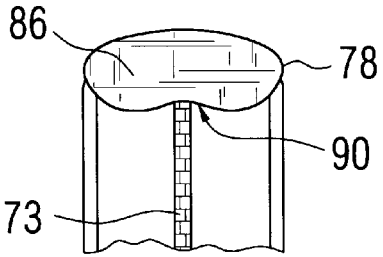

Referring to FIG. 8, the cover 22 has end flaps 86 extending generally perpendicular to the outer surface 16 of the boot back and extending adjacent edges 88 of the spine 36 to protect the edges 88. The flaps 86 have a notch 90 to facilitate outward movement of binder levers 92 during operation of the binder assembly 80.

One of ordinary skill in the art can envision numerous variations and modifications. All of these modifications are contemplated by the true spirit and scope of the following claims.

What is claimed:

1. An attachment for a folder, comprising:

(a) a boot attachable to an exterior of a folder and defining an outer boot recess open in an outward direction; and (b) a handle having:

(i) a handle body having lateral sides having a length and separated by a width that is substantially smaller than the length, wherein the handle body is receivable in the boot recess in a retracted position such that the boot extends along the lateral sides of the handle body, and (ii) a support member attached to the handle body movably associated with the boot such that the handle body is retractably extendable from the retracted position to an extended position in which the handle body is spaced from the boot back for enabling grasping of the handle body by a user.

2. The attachment of claim 1, wherein:

(a) the boot has:

(i) an outer boot surface, (ii) an at least semirigid skeleton of sufficient stiffness for retaining the shape of the boot, (iii) a resilient cover forming an outer boot surface of the boot and being less stiff than the skeleton and disposed therearound and in abutment therewith for providing a grippable surface, such that the skeleton supports the resilient cover.

3. The attachment of claim 2, wherein the handle body and the cover comprise a same rubber material which forms the boot surface.

4. The attachment of claim 1, wherein the support members resiliently bias the handle body towards the retracted position.

5. The attachment of claim 1, wherein the boot includes an end flap extending generally perpendicular to the boot body for extending adjacent an edge of a file panel when the boot is attached thereto.

6. The attachment of claim 1, wherein the boot surrounds substantially the entire handle body in a plane generally parallel with the recessed when the handle body is in the retracted position.

7. A folder and attachment combination, comprising:

(a) the attachment of claim 1, wherein the boot has a first and second lateral edges and a boot width therebetween; and (b) a folder comprising first and second at least semirigid outer panels pivotably attached to each other, the first panel having panel edges including first and second lateral panel edges and a panel width therebetween;

wherein the boot width is at least approximately equal to the panel width.

8. The combination of claim 7, wherein the boot is substantially coextensive with the panel edges.

9. The combination of claim 7, wherein:

(a) the folder comprises a third panel pivotably connected to the first panel; and (b) the first panel is a folder spine.

10. An attachment for a folder, comprising:

(a) a boot having a guide defining a race with a stop, the boot being attachable to a folder and defining a boot recess; and (b) a handle having:

(i) a handle body having an outer handle surface and being receivable in the boot recess in a retracted position such that the boot substantially surrounds the body; and (ii) a support member having a guided portion and being attached to the handle body and movably associated with the race below the boot surface such that the handle body is retractably extendable from the retracted position to an extended position in which the handle body is spaced from the boot back for enabling grasping of the handle body by a user, wherein the stop is associated with the guided portion for preventing movement thereof past a location in which the handle is in the extended position;

wherein the guided portion has a naturally assumed position when the handle is in the retracted position, and the guide defines a race opening, the race being open at the race opening, the race opening being dimensioned and associated with the handle such that the guided portion of the support member is receivable through the race opening when the guided member is moved past the naturally assumed position in a direction opposite the stop of the race.

11. The attachment of claim 10, wherein:

(a) the race comprises an elongated slot; and (b) the guided portion comprises a pin received within the slot and extending laterally beyond the guided portion.

12. The attachment of claim 10, wherein:

(a) the guide comprises a laterally extending control portion; and (b) the support member includes a controlled portion that is disposed beneath and in abutment with the control portion such that the controlled portion is guided around the control portion when the handle body is moved between the retracted and extended positions.

13. The attachment of claim 12, wherein the controlled portion comprises a substantially flat strip.

14. The attachment of claim 12, wherein the boot comprises:

(a) a back member having the outer boot surface; and (b) a rigid plate that includes the guide and extends beneath the handle body and the outer surface.

15. The attachment of claim 14, wherein:

(a) the back member defines a handle opening configured to receive the handle body therethrough during assembly; and (b) the boot comprises a handle positioner, mounted to a plate facing outwardly towards the handle opening, the handle positioner being configured to block the handle body from further retraction beyond the retracted position.

16. The attachment of claim 14, wherein the back member and the plate are associated in interlocking relationship for preventing relative movement therebetween tangent to a folder spine when the attachment is attached thereto.

17. An attachment for a folder, comprising:

(a) a boot:

(i) having a base that is attachable to an exterior of a folder in abutment therewith;

(ii) having an outer boot surface that follows a smooth outer contour; and (iii) defining a boot recess that interrupts the outer surface open in an outward direction away from the base; and (b) a handle having:

(i) a handle body having lateral sides having a length and separated by a width that is substantially smaller than the length, wherein the handle body is receivable in the boot recess in a retracted position such that the boot extends along the lateral sides of the handle body, the handle body having an outer handle surface that generally continues the outer contour when the handle is in the retracted position; and (ii) a support member attached to the handle body movably associated with the boot such that the handle body is retractably extendable from the retracted position to an extended position in which the handle body is spaced from the boot back for enabling grasping of the handle body by a user.

18. The attachment of claim 17, wherein the handle surface is generally flush with the boot surface when in the retracted position.

19. The attachment of claim 17, wherein:

(a) the boot surface is disposed at a predetermined boot height from the base; and (b) the handle surface is disposed approximately at the boot height from the boot base when in the retracted position.

20. The attachment of claim 17, wherein the recess is configured such that a grasping indentation is defined therewithin between the boot and the handle body adjacent the lateral sides for receiving a user's fingertips for grasping of the handle body.

21. The attachment of claim 20, wherein:

(a) the recess has a recess width extending laterally thereacross; and (b) the handle body has a handle width extending laterally thereacross that is narrower than the recess width, such that the grasping indentation is defined laterally between the handle body and the boot.

22. A folder and attachment combination, comprising:

(a) the attachment of claim 1; and (b) a folder, wherein the attachment is fixed to the folder.

23. The attachment of claim 1, wherein the boot comprises an underside configured for attachment to the folder, and the outward direction is generally away from the underside.

24. The attachment of claim 1, wherein in the retracted position the boot extends along substantially the entire lateral sides of the handle body.

25. The attachment of claim 1, wherein the boot has an end flap extending in a direction opposite from the outward direction for placement adjacent folder edge of the folder exterior to protect said folder edges.

* * * * *